US007159862B2

(12) United States Patent
Matsutomo et al.

(10) Patent No.: US 7,159,862 B2
(45) Date of Patent: Jan. 9, 2007

(54) SHEET DELIVERY MECHANISM FOR IMAGE FORMING APPARATUS

(75) Inventors: Yasushi Matsutomo, Nara (JP); Yoshiaki Hiramoto, Yamatokoriyama (JP); Susumu Murakami, Soraku-gun (JP); Hideshi Izumi, Ikoma (JP); Yoshie Iwakura, Higashiosaka (JP); Motokazu Nakao, Sakurai (JP); Yoshiyuki Nagai, Yamatokoriyama (JP); Shigeru Yoshida, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 41 days.

(21) Appl. No.: 10/756,117

(22) Filed: Jan. 12, 2004

(65) Prior Publication Data

US 2004/0145112 A1 Jul. 29, 2004

(30) Foreign Application Priority Data

Jan. 14, 2003 (JP) ..... P2003-006199
Feb. 4, 2003 (JP) ..... P2003-027368

(51) Int. Cl.
*B65H 5/22* (2006.01)

(52) U.S. Cl. ..... 271/3.14; 271/4.01; 271/207; 414/791.2; 414/794.8

(58) Field of Classification Search ..... 271/3.14, 271/4.01, 314, 272, 207; 414/791.2, 794.8; 399/404, 363, 365, 381, 411, 405; D18/36, D18/37, 38, 39, 53
See application file for complete search history.

(56) References Cited

U.S. PATENT DOCUMENTS 4,480,825 A * 11/1984 Landa ..... 271/81
4,857,963 A * 8/1989 Sutou ..... 399/381
D331,595 S * 12/1992 Ishida ..... D18/38
5,513,839 A * 5/1996 Green ..... 270/58.07
D406,161 S * 2/1999 Yoshida et al. ..... D18/36
D425,551 S * 5/2000 Shiozaki et al. ..... D18/53
D425,929 S * 5/2000 Imai ..... D18/36
D433,439 S * 11/2000 Yoshida et al. ..... D18/36
D438,559 S * 3/2001 Matsumoto et al. ..... D18/39
D447,765 S * 9/2001 Hatanaka et al. ..... D18/39
D451,124 S * 11/2001 Isomoto ..... D18/39
6,382,615 B1 * 5/2002 Ishiguro et al. ..... 270/58.12
D458,298 S * 6/2002 Katsuyama et al. ..... D18/36
D459,752 S * 7/2002 Shiozaki ..... D18/36
6,473,590 B1 * 10/2002 Matsumoto et al. ..... 399/404
6,581,930 B1 * 6/2003 Kim ..... 271/272
D487,107 S * 2/2004 Ohashi ..... D18/39
6,690,901 B1 * 2/2004 Katsuyama et al. ..... 399/107
6,725,011 B1 * 4/2004 Sato ..... 399/405
D493,817 S * 8/2004 Yoshida et al. ..... D18/39

(Continued)

FOREIGN PATENT DOCUMENTS

JP 05-186121 7/1993

(Continued)

*Primary Examiner*—David H. Bollinger
(74) *Attorney, Agent, or Firm*—David C. Conlin; David A. Tucker; Edwards Angell Palmer & Dodge LLP

(57) ABSTRACT

A roller turning force generator is connected to a driving gear which is mounted on a shaft. The shaft is connected to offset roller assemblies disposed in an offset mechanism via connecting gears. The offset roller assemblies rotatably supported inside the offset mechanism are turned by a driving force transmitted from the roller turning force generator to discharge individual sheets of a printing medium in a sheet transport direction. The offset mechanism is linked to an offsetting force generator so that the offset mechanism can be shifted along a direction perpendicular to the sheet transport direction.

11 Claims, 11 Drawing Sheets

U.S. PATENT DOCUMENTS

| | | | | |
|---|---|---|---|---|
| D494,211 | S * | 8/2004 | Yoshida et al. | D18/39 |
| 6,786,483 | B1 * | 9/2004 | Nishimura et al. | 271/270 |
| D501,019 | S * | 1/2005 | Yoshida et al. | D18/39 |
| D502,210 | S * | 2/2005 | Katori et al. | D18/39 |
| 2002/0015604 | A1 * | 2/2002 | Watanabe | 399/405 |
| 2002/0044810 | A1 * | 4/2002 | Sato et al. | 399/405 |
| 2002/0076233 | A1 * | 6/2002 | Kaiho | 399/92 |

FOREIGN PATENT DOCUMENTS

| | | |
|---|---|---|
| JP | 61-045855 | 3/1996 |
| JP | 08-208091 | 8/1996 |
| JP | 11-199124 | 7/1999 |
| JP | 2000-086056 | 3/2000 |

* cited by examiner

SHEET DELIVERY MECHANISM FOR IMAGE FORMING APPARATUS

CROSS REFERENCE

This Nonprovisional application claims priority under 35 U.S.C. § 119(a) on Patent Application Nos. 2003-006199 and 2003-027368 respectively filed in Japan on Jan. 14 and Feb. 4, 2003, the entire contents of which are hereby incorporated by reference.

BACKGROUND OF THE INVENTION

The present invention relates to a sheet delivery mechanism of an image forming apparatus, such as a printer or a copying machine, for discharging sheets of printing media carrying printed images as well as to an image forming apparatus incorporating the sheet delivery mechanism.

When an image forming apparatus for producing printed images on sheets of paper outputs multiple copies of printed sheets onto a sheet delivery tray provided outside a housing of the apparatus, for instance, it is usually difficult to discern boundaries between the individual copies and, therefore, a user needs to sort the individual copies upon completion of image forming operation. When producing two copies of a 10-page document by the image forming apparatus, for example, the user has to find out a boundary between the first and second copies, or the boundary between a last page of the first copy and a first page of the second copy, and separate the two copies from each other.

There are several known types of sheet delivery devices applicable to conventional image forming apparatuses for realizing efficient sorting operation. These sheet delivery devices are designed to selectively deliver multiple copies of printed sheets in different ways or at different (offset) locations by varying sheet delivery positions for easy sorting. Four specific approaches employed in these sheet delivery devices are as follows.

A first approach proposed in Japanese Laid-open Patent Publication No. H11-199124, for example, is to feed printing paper of the same size in different orientations (portrait and landscape) for every other copy of a document and output printed sheets in the same orientations. Specifically, sheets for printing one copy are fed in such a way that a short side of each sheet goes first and sheets for printing next copy are fed in such a way that a long side of each sheet goes first. As the printed sheets are discharged in the same orientations, individual copies can be easily distinguished.

A second approach disclosed in Japanese Laid-open Patent Publication No. 2000-086056, for example, employs an offset tray. Although printed sheets are discharged from a fixed sheet output position, the offset tray is shifted (offset) to different positions so that the printed sheets are delivered to different locations for easy sorting.

A third approach proposed in Japanese Laid-open Patent Publication No. H05-186121, for example, includes a pair of paper output rollers individually mounted on two shafts and a differential gear mechanism provided between the two shafts. While the two paper output rollers nip a printed sheet for discharging it, a difference is produced between rotating loads of the two paper output rollers. The differential gear mechanism produces a difference in rotating speed between the two paper output rollers so that multiple copies of printed sheets are output to different sheet delivery positions for easy sorting.

A fourth approach shown in Japanese Laid-open Patent Publication No. H08-208091, for example, includes a driving roller assembly and pinch roller assemblies for discharging printed sheets. While a printed sheet to be discharged is nipped between the roller member and the pinch roller assemblies, the driving roller assembly is shifted in its axial direction. As the nipped sheet pulled by the driving roller assembly is also shifted in the axial direction of the driving roller assembly, the sheet delivery position of each sheet is varied to facilitate a sorting job.

An image forming apparatus recently developed is a so-called front access type shown in FIG. 7, which is intended to achieve compactness in design. Referring to FIG. 7, the front-access-type image forming apparatus includes an image scanning section 160 located at an upper part, a paper feed section 170 located at a lower part for feeding sheets of paper used for image forming, and an image forming section 180 disposed between the image scanning section 160 and the paper feed section 170. The image scanning section 160, the image forming section 180 and the paper feed section 170 are arranged generally in a U shape in cross section. A sheet delivery section 190 to which each sheet carrying a printed image is output is provided in a space between the image scanning section 160 and the paper feed section 170. To meet an increasing demand for advanced features, this type of image forming apparatus incorporates a duplex (double-sided) image-forming function which is realized by a switchback paper transfer method instead of a normally used intermediate tray method. In the switchback paper transfer method, a sheet of paper is reversed by transferring the sheet in a direction opposite to an ordinary sheet transport direction through a paper transfer path S' by means of a pair of paper output rollers 191 immediately after an image has been formed on one side of the sheet.

For the front-access-type image forming apparatus, it is not desirable to employ the aforementioned first approach of Japanese Laid-open Patent Publication No. H11-199124. This is because it is necessary to provide multiple paper cassettes for each paper size to feed the printing paper in different orientations and this makes it difficult to achieve compactness of the apparatus. The aforementioned second approach of Japanese Laid-open Patent Publication No. 2000-086056 is not desirable for the front-access-type image forming apparatus either, because it is difficult to accommodate a movable offset tray in the limited space of the sheet delivery section 190. Accordingly, the aforementioned third and fourth approaches shown in Japanese Laid-open Patent Publication Nos. H05-186121 and H08-208091, respectively, seem to be suited to the front-access-type image forming apparatus, because arrangements of these approaches do not require a large space.

The arrangement of Japanese Laid-open Patent Publication No. H05-186121 is not so preferable, however. Since a sheet nipped by the two paper output rollers turning at different rotating speeds is discharged as if along a parabola and nipped portions of the sheet are advanced at different speeds, an undesired load, warpage or slack is likely to occur in the sheet.

In the arrangement of Japanese Laid-open Patent Publication No. H08-208091, a driving force transmission device which is connected to a prime mover and transmits a driving force for turning the driving roller assembly needs to be shifted together with the driving roller assembly for design-related reasons. Therefore, a large space is needed to allow the shifting of the driving roller assembly in its axial direction and, as a consequence, it is difficult to provide multiple sheet delivery positions offset from a reference position. Furthermore, if a gear mechanism is used for connecting the driving force transmission device to the prime mover, gears of the mechanism would gradually wear due to friction caused by the shifting of the driving roller assembly in its axial direction and slip over one another, eventually becoming difficult to precisely transmit the driving force to the driving roller assembly.

In addition, since the driving force transmission device shifts the driving roller assembly only without shifting the pinch roller assemblies, the sheet nipped between the roller member and the pinch roller assemblies is dragged along the pinch roller assemblies so that the sheet shifts together with the driving roller assembly. Thus, when images are to be formed on both sides of the sheet, the image formed on one side is likely to be smeared due to friction between the sheet and the pinch roller assemblies.

If a mechanism including a cam and a spring is used for connecting the driving force transmission device to the prime mover, an elastic force of the spring for shifting the driving roller assembly in its axial direction would gradually decrease due to deterioration over time and it might become impossible for the driving force transmission device to exactly shift the driving roller assembly to specific positions.

For the aforementioned front-access-type image forming apparatus which is intended to achieve compactness in design, it is essential that the paper output rollers be controlled with increased accuracy since the apparatus employs the duplex image-forming function based on the switchback paper transfer method. Specifically, the paper output rollers should be repeatedly shifted in their axial direction with increased positioning accuracy along the axial direction and with increased accuracy of driving force transmission from the prime mover to output multiple copies of printed sheets at specific offset locations. When a sheet carrying an image already formed on one side is switched back for performing a duplex image forming job, for example, a paper jam or an oblique paper feed may occur while the sheet is being transferred for forming an image on a reverse side if the paper output rollers 191 are not correctly positioned or the driving force is not properly transmitted to turn the paper output rollers 191 in their forward and reverse turning directions. These paper feed problems could result in such a problem that the images formed on both sides of the sheet are misregistered from each other. When the arrangement of Japanese Laid-open Patent Publication No. H08-208091 is employed in the front-access-type image forming apparatus, the aforementioned problem is likely to occur in the duplex image forming job.

As stated earlier, one of pending problems of the conventional image forming apparatuses is that it is difficult to distinguish boundaries between multiple copies of a multiple-page document. More specifically, it is difficult for a user to discern a boundary between the last page of the first copy and the first page of the second copy, for example, so that the user has to find out the boundary between the first and second copies and separate the individual copies from each other.

To overcome this inconvenience, the prior art proposes various kinds of sheet delivery mechanisms featuring a shifter function which enables a user to distinctly discern boundaries between multiple copies (prints) of a multiple-page document. Arrangements for realizing the shifter function are roughly divided into three types.

A first arrangement is to feed printing paper in different orientations (portrait and landscape) and rotate printed images clockwise and counterclockwise by 90 degrees for every other copy of a document as proposed in Japanese Laid-open Patent Publication No. H11-199124, for example.

A second arrangement is to use a movable offset tray which is shifted (offset) to different positions when receiving multiple copies of printed sheets ejected from a fixed sheet output position as proposed in Japanese Laid-open Patent Publication No. 2000-086056, for example.

A third arrangement is to vary the sheet delivery position by shifting (offsetting) printed sheets being discharged by means of a driving roller assembly provided in a sheet delivery section as proposed in Japanese Laid-open Patent Publication No. H08-208091, for example.

As already mentioned, the aforementioned front-access-type image forming apparatus has the duplex image-forming function to meet the demand for advanced features. To achieve compact design of the apparatus, the duplex image-forming function is realized by the switchback paper transfer method, in which the sheet is reversed for performing each duplex image forming job immediately after an image has been formed on one side of the sheet, and not by the ordinary intermediate tray method.

It is not desirable to use the aforementioned first arrangement for implementing the shifter function in the front-access-type image forming apparatus. This is because it is necessary to provide multiple paper cassettes for each paper size to feed the printing paper in different orientations in the first arrangement and this makes it difficult to achieve compactness of the apparatus. It is not desirable to use the aforementioned second arrangement for implementing the shifter function in the front-access-type image forming apparatus either. This is because it is quite difficult to accommodate a movable sheet delivery tray (offset tray) in a limited space available in a central empty space of a generally U-shaped structure (in cross section) of the apparatus.

The aforementioned third arrangement is seemingly suited to the front-access-type image forming apparatus. This is because a sheet delivery tray may be held at a fixed position and there is no significant difficulty in reducing the size of the apparatus in the third arrangement, in which the driving roller assembly located in the sheet delivery section offsets the printed sheets to vary the sheet delivery position. When the third arrangement is employed in the image forming apparatus, however, these arises a problem related to ease of stacking the printed sheets output to offset delivery positions. If the image forming apparatus can not neatly stack the printed sheets delivered to offset positions, it may become impossible for the user to easily separate individual copies.

SUMMARY OF THE INVENTION

In view of the foregoing, it is an object of the invention to provide a sheet delivery mechanism which can precisely transmit a driving force of a prime mover to offset rollers and precisely move the offset rollers in their axial direction without causing wear of a driving force transmission mechanism so that sheets of a printing medium are selectively discharged to multiple sheet delivery positions located along a direction perpendicular to a sheet transport direction.

It is another object of the invention to provide a sheet delivery mechanism which can be installed in a limited space.

It is still another object of the invention to provide a sheet delivery mechanism for a front-access-type image forming apparatus featuring improved sheet stacking performance.

The invention provides an output sheet shifter unit which can selectively discharge printed sheets transferred through a sheet transport path to multiple sheet delivery positions located along a direction perpendicular to a sheet transport direction by shifting offset rollers which are rotatably supported for discharging each sheet in the sheet transport direction. The offset rollers are turned by a driving force transmitted from a roller turning force generator via a driving force transmission mechanism and shifted along the direction perpendicular to the sheet transport direction. The output sheet shifter unit includes an offset mechanism rotatably supporting the offset rollers and incorporating part of the driving force transmission mechanism which transmits the driving force for turning the offset rollers and moves together with the offset rollers. The offset mechanism is supported movably along the direction perpendicular to the sheet transport direction.

In this construction, the output sheet shifter unit includes the offset mechanism in which the offset rollers are rotatably supported to discharge individual sheets in the sheet transport direction and part of the driving force transmission mechanism for transmitting the driving force for turning the offset rollers is disposed movably along the direction perpendicular to the sheet transport direction together with the offset rollers.

The driving force transmission mechanism does not move in its entirety but only part of the driving force transmission mechanism and the offset rollers disposed in the offset mechanism move along the direction perpendicular to the sheet transport direction when the offset mechanism is shifted (offset). Thus, it is possible to reduce the amount of space needed for allowing the shifting of the offset rollers along the direction perpendicular to the sheet transport direction.

The invention also provides a sheet delivery mechanism suited for a front-access-type image forming apparatus which includes an image scanning section located at an upper part of a housing of the apparatus for scanning an original to obtain image information therefrom, a sheet feeding section located at a lower part of the housing for feeding individual sheets used for image forming, and an image forming section disposed between the image scanning section and the sheet feeding section at one side of the housing. In this image forming apparatus, the image scanning section, the image forming section and the sheet feeding section are arranged generally in a U shape in cross section in the housing. A sheet delivery portion (tray) is formed in an inner empty space of the housing just between the image scanning section and the sheet feeding section. The sheet delivery portion has a flat surface and an inclined surface sloping downward from a rear end of the flat surface toward a rear wall of the sheet delivery portion along a direction perpendicular to a sheet transport direction.

In this construction, each sheet discharged toward the flat surface slightly warps at its side edge portion along the inclined surface formed between the flat surface and the rear wall of the sheet delivery portion. This makes it easier to remove discharged sheets from the sheet delivery portion.

The invention further provides an image forming apparatus incorporating the aforementioned sheet delivery mechanism.

Other features and advantages of the present invention will be more readily understood from the following detailed description when read in conjunction with accompanying drawings.

DETAILED DESCRIPTION OF THE PREFERRED EMBODIMENTS OF THE INVENTION

Figure 1:
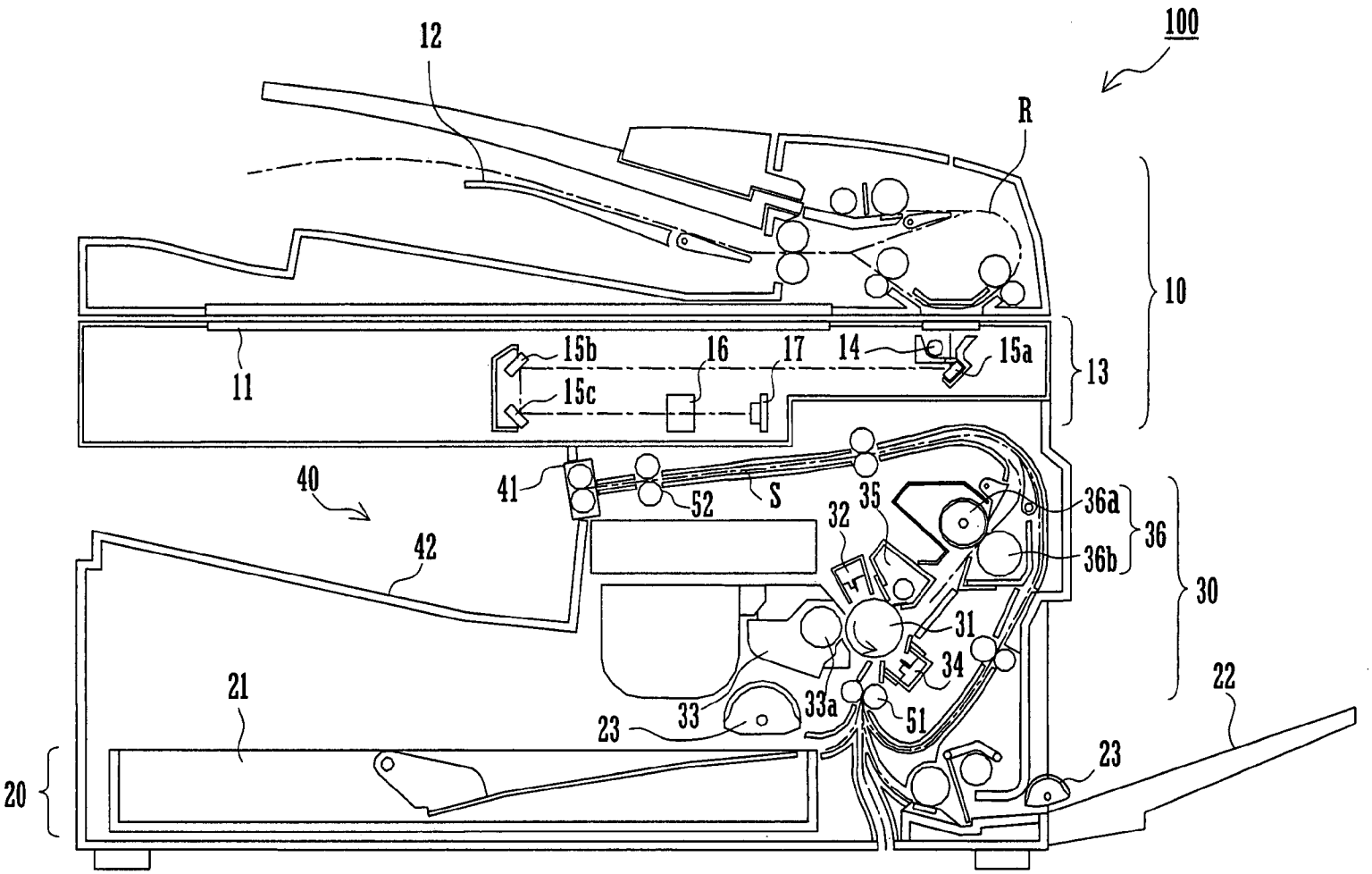
FIG. 1 is a diagram showing the construction of an image forming apparatus provided with an output sheet shifter unit according to a preferred embodiment of the invention.

FIG. 1 is a diagram showing the construction of an image forming apparatus 100 provided with an output sheet shifter unit 41 according to a first embodiment of the invention. The image forming apparatus 100 allows user choice of multiple image forming modes, that is, copier mode, printer mode and facsimile mode. In any of these image forming modes, the image forming apparatus 100 forms images on sheets of paper (or any other types of printing media, such as films for an overhead projector).

The image forming apparatus 100 includes an image scanning section 10, a sheet feeding section 20, an image forming section 30 and a sheet delivery section 40 as well as other elements, such as an operator panel, which are not illustrated.

The image scanning section 10 located at an upper part of a housing of the image forming apparatus 100 includes a platen glass 11, an original loading tray 12 and an optical scanning system 13. The optical scanning system 13 incorporates a light source 14, multiple reflecting mirrors 15*a*, 15*b*, 15*c*, an optical lens 16 and a charge-coupled device (CCD) 17. The light source 14 emits light onto an original placed on the platen glass 11 or an original being transferred from the original loading tray 12 through an original transport path R. The multiple reflecting mirrors 15*a*, 15*b*, 15*c* successively reflects light reflected from the original to guide the reflected light to the optical lens 16. The optical lens 16 converges the reflected light guided by the reflecting mirrors 15*a*, 15*b*, 15*c* onto the CCD 17 which performs a photoelectric conversion process to convert the reflected light into an electric signal.

The sheet feeding section 20 located at a lower part of the housing of the image forming apparatus 100 includes a sheet cassette 21, a manual feed tray 22 and pickup rollers 23. Sheets are fed from the sheet cassette 21 or the manual feed tray 22 during image forming operation. The pickup rollers 23 individually provided to the sheet cassette 21 and the manual feed tray 22 rotate to feed each sheet from the sheet cassette 21 or the manual feed tray 22 into a sheet transport path S.

The image forming section 30 is located beneath the image scanning section 10 at one side of the housing of the image forming apparatus 100 where the manual feed tray 22 is provided. The image forming section 30 includes a laser scanning unit (hereinafter referred to as the LSU), a photosensitive drum 31 and a fuser unit 36. The image forming section 30 further includes a charging unit 32, a developing unit 33, an image transfer unit 34 and a discharging unit 35 which are disposed in this order around the photosensitive drum 31 in a rotating direction of the photosensitive drum 31 shown by an arrow in FIG. 1.

The sheet delivery section 40 located above the sheet cassette 21 includes the aforementioned output sheet shifter unit 41 and a sheet delivery tray 42. The output sheet shifter unit 41 discharges sheets carrying printed images from the sheet transport path S to offset positions on the sheet delivery tray 42. The sheet delivery tray 42 receives the individual sheets output by the output sheet shifter unit 41. The operator panel has a plurality of input keys (not shown) which accept various settings, such as the number of copies and a printing scale factor, entered by a user. The output sheet shifter unit 41 will be later described in greater detail.

When copying original images on sheets in the copier mode, the user places an original to be copied on the platen glass 11 or on the original loading tray 12 of the image scanning section 10. Then, the user sets the number of copies and a printing scale factor, for instance, by pressing appropriate input keys on the operator panel and presses a start key (not shown).

When the start key is pressed, the image forming apparatus 100 causes the pickup roller 23 of the sheet cassette 21 or the manual feed tray 22 to feed a sheet therefrom into the sheet transport path S. The sheet is first fed up to registration rollers 51. The registration rollers 51 nip a leading edge of the sheet located at a forwardmost extremity in a sheet transport direction so that a sub-scanning direction of the sheet becomes parallel to an axial direction of the registration rollers 51 and a toner image formed on the photosensitive drum 31 correctly aligns with the sheet when transferred thereto.

Image data picked up by the image scanning section 10 is subjected to an image processing process performed under conditions set by user input keys, for instance, and transmitted to the LSU as print data. An outer surface of the photosensitive drum 31 is uniformly charged to a specific potential by the charging unit 32. The LSU forms an electrostatic latent image of the original image on the surface of the photosensitive drum 31 by projecting laser light based on the image data (print data) by means of a polygon mirror and various lenses which are not illustrated. Subsequently, toner adhering to an outer surface of a toner drum 33*a* provided in a developing tank (not shown) of the developing unit 33 with part of the toner drum 33*a* directly facing the photosensitive drum 31 is attracted to the surface of the photosensitive drum 31 according to a distribution of charged and uncharged areas on the surface of the photosensitive drum 31. As a result, the latent image is converted into a visual toner image.

Then, the sheet nipped by the registration rollers 51 is passed through a gap between the photosensitive drum 31 and the image transfer unit 34 at correct registration with the toner image. While the sheet is being transported, the toner image is transferred from the surface of the photosensitive drum 31 onto the sheet by an image transfer roller (not shown) provided in the image transfer unit 34. Residual toner left on the surface of the photosensitive drum 31 is scraped off by a cleaning blade of a drum unit (not shown) and collected by a cleaner unit (not shown). The sheet carrying the transferred toner image is passed through an upper heat roller 36*a* and a lower heat roller 36*b* provided in the fuser unit 36. Heat and pressure applied by the upper and lower heat roller 36*a*, 36*b* fuse and fix the toner image onto the sheet. The sheet is then delivered to the sheet delivery tray 42 by the output sheet shifter unit 41.

Figure 2:
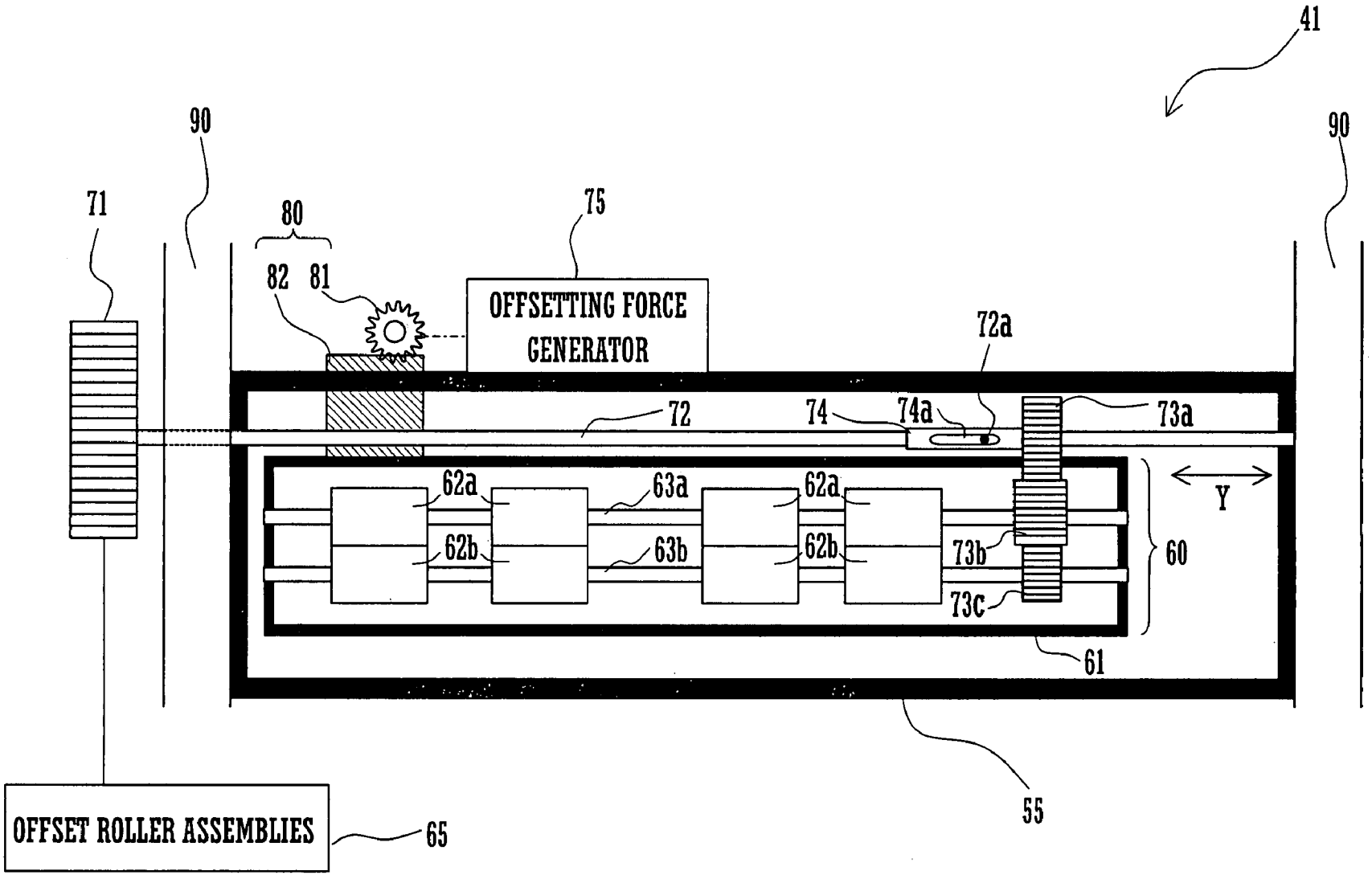
FIG. 2 is a sectional side view showing the construction of the output sheet shifter unit.
Figure 3:
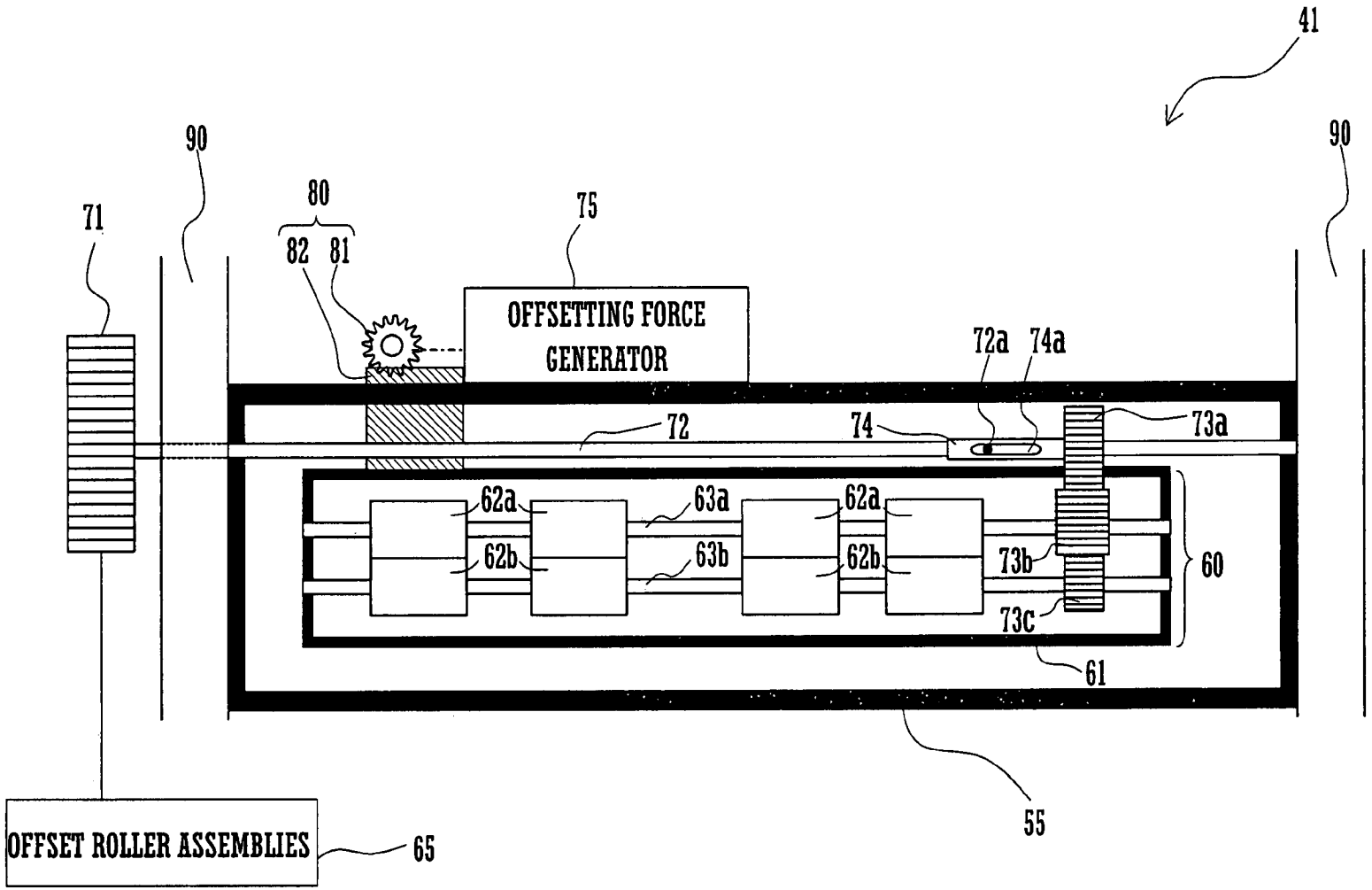
FIG. 3 is also a sectional side view showing the construction of the output sheet shifter unit.

FIGS. 2 and 3 are sectional side views showing the construction of the output sheet shifter unit 41 of the present embodiment. The output sheet shifter unit 41 includes an enclosure 55, an offset mechanism 60, a roller turning force generator 65, a driving force transmission mechanism 70, an offsetting force generator 75 and an offsetting force transmission mechanism 80. The output sheet shifter unit 41 thus constructed ejects each sheet carrying a printed image which is being transferred through the sheet transport path S onto the sheet delivery tray 42. If the user has entered a setting for activating a sorting function by pressing appropriate input keys on the operator panel, the output sheet shifter unit 41 selectively delivers printed sheets to offset delivery positions B and C as well as to a normal (reference) delivery position A on the sheet delivery tray 42 by successively shifting the individual sheets along the direction of an arrow Y shown in FIG. 4, perpendicularly to the sheet transport direction.

The enclosure 55, which is supported by a frame 90 of the housing of the image forming apparatus 100, incorporates the offset mechanism 60 and the driving force transmission mechanism 70 in an internal space and is fitted with the offsetting force generator 75 and the offsetting force transmission mechanism 80 disposed on the outside. The offset mechanism 60, which includes an internal enclosure 61 and a pair of upper and lower offset roller assemblies 62, shifts along the direction of an arrow Y (FIG. 2) from a position shown in FIG. 2 to a position shown in FIG. 3, for instance, to selectively output the printed sheets to the individual delivery positions A, B, C. The internal enclosure 61 rotatably supports the individual offset roller assemblies 62 so that the offset roller assemblies 62 can push out the printed sheets in the sheet transport direction. The offset roller assemblies 62 carry multiple pairs of upper and lower rollers 62*a*, 62*b* as illustrated. These rollers 62*a*, 62*b* rotate while nipping each sheet to deliver it onto the sheet delivery tray 42.

The roller turning force generator 65 produces a driving force for turning the offset roller assemblies 62. The driving force transmission mechanism 70, which includes a driving gear 71, a shaft 72, connecting gears 73*a*, 73*b*, 73*c* and a sliding sleeve 74, transmits the driving force of the roller turning force generator 65 to the offset roller assemblies 62. Mounted directly on the shaft 72, the driving gear 71 connected to the roller turning force generator 65 turns the shaft 72.

The shaft 72 is rotatably supported in the frame 90 of the housing. Mounted on the shaft 72, the sliding sleeve 74 is made slidable along the shaft 72. Also, the shaft 72 supports the offset mechanism 60 via the sliding sleeve 74 and the connecting gears 73*a*, 73*b*, 73*c* movably along the direction of the arrow Y (FIG. 2) which is perpendicular to the sheet transport direction. To limit a movable range of the offset mechanism 60 and the accompanying connecting gears 73*a*, 73*b*, 73*c*, the shaft 72 has a stopper pin 72*a* which projects outward through a slotted hole 74*a* formed in the sliding sleeve 74, the slotted hole 74*a* extending along an axial direction of the sliding sleeve 74.

The three connecting gears 73*a*, 73*b*, 73*c* are meshed together with the connecting gear 73*b* placed between the gears 73*a* and 73*c*. The connecting gear 73*a* protrudes from the internal enclosure 61 through a hole formed therein on a side of the internal enclosure 61 facing the shaft 72. The connecting gear 73*a* thus protruding is fitted on the sliding sleeve 74 and supported thereby, so that the connecting gear 73*a* is slidable over the shaft 72 along the direction of the arrow Y together with the sliding sleeve 74. When the shaft 72 rotates, its rotary motion is transmitted to the connecting gear 73*a* via the stopper pin 72*a* of the shaft 72. Therefore, the shaft 72, the sliding sleeve 74 and the connecting gear 73*a* together rotate as a single piece. The connecting gear 73*b* is fitted on one end of a shaft 63*a* supporting the rollers 62*a* of the upper offset roller assembly 62, so that the connecting gear 73*b* turns the upper rollers 62*a* via the shaft 63*a*. On the other hand, the connecting gear 73*c* is fitted on one end of a shaft 63*b* supporting the rollers 62*b* of the lower offset roller assembly 62, so that the connecting gear 73*c* turns the lower rollers 62*b* via the shaft 63*b*.

As the gears 73*b* and 73*c* turn in opposite directions, the upper rollers 62*a* and the lower rollers 62*b* turn in such a way that their contact portions (nip areas) correctly push out each sheet in the aforementioned sheet transport direction.

The offsetting force generator 75 connected to the offsetting force transmission mechanism 80 produces a driving force for shifting the offset mechanism 60 along the direction of the arrow Y (FIG. 2). The offsetting force transmission mechanism 80 includes a pinion 81 and a rack 82. The pinion 81 is rotatably supported and connected to the offsetting force generator 75 and the rack 82. When driven by the offsetting force generator 75, the pinion 81 rotates and causes the rack 82 to move in the direction of the arrow Y. The rack 82 affixed to an upper rear position of the internal enclosure 61 as illustrated in FIG. 2 causes the internal enclosure 61 to shift along the direction of the arrow Y when moved by the pinion 81. When the internal enclosure 61 moves in this fashion, the connecting gear 73*a* and the sliding sleeve 74 also move along the direction of the arrow Y as one of edges of the hole formed in the internal enclosure 61 comes into contact with one of side surfaces of the connecting gear 73*a*.

Figure 6:
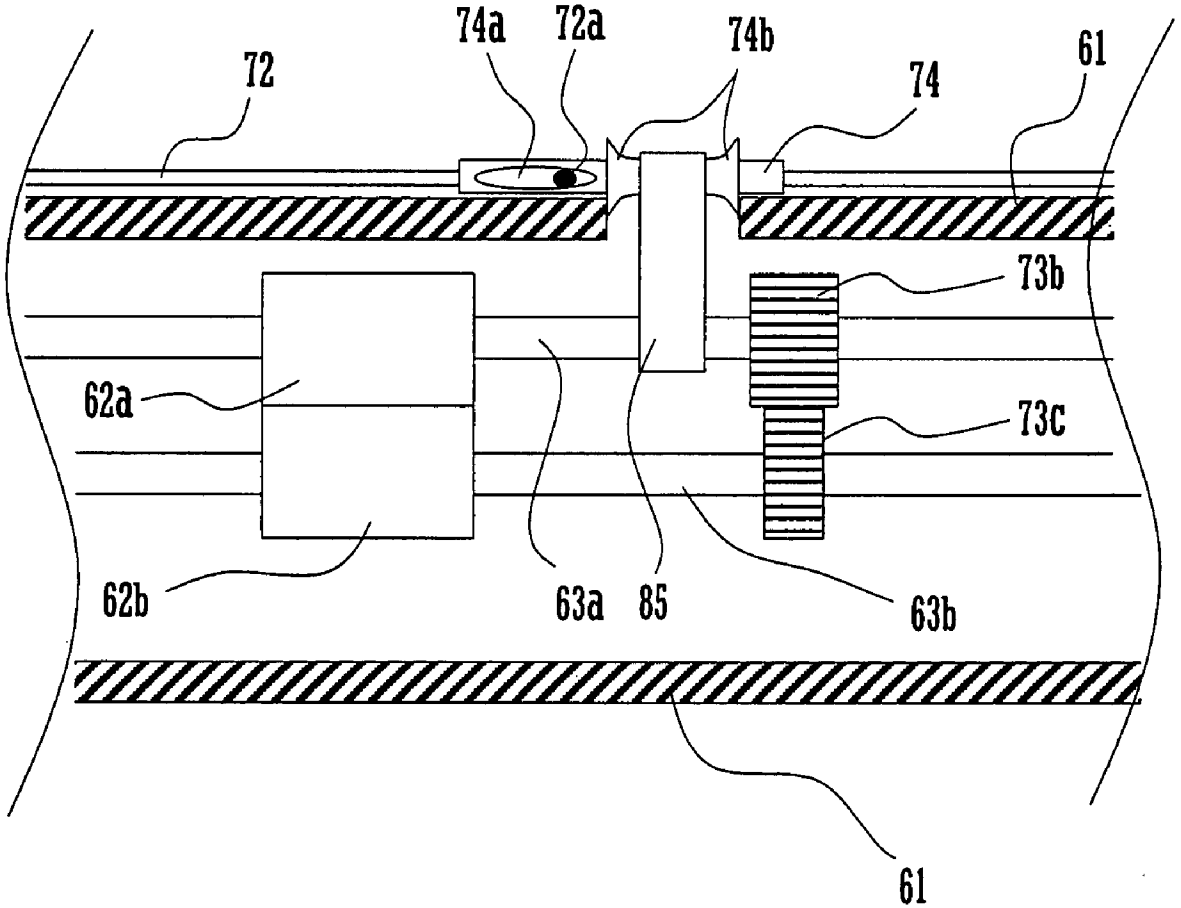
FIG. 6 is a fragmentary sectional side view showing the construction of an output sheet shifter unit in one alternative arrangement.
Figure 7:
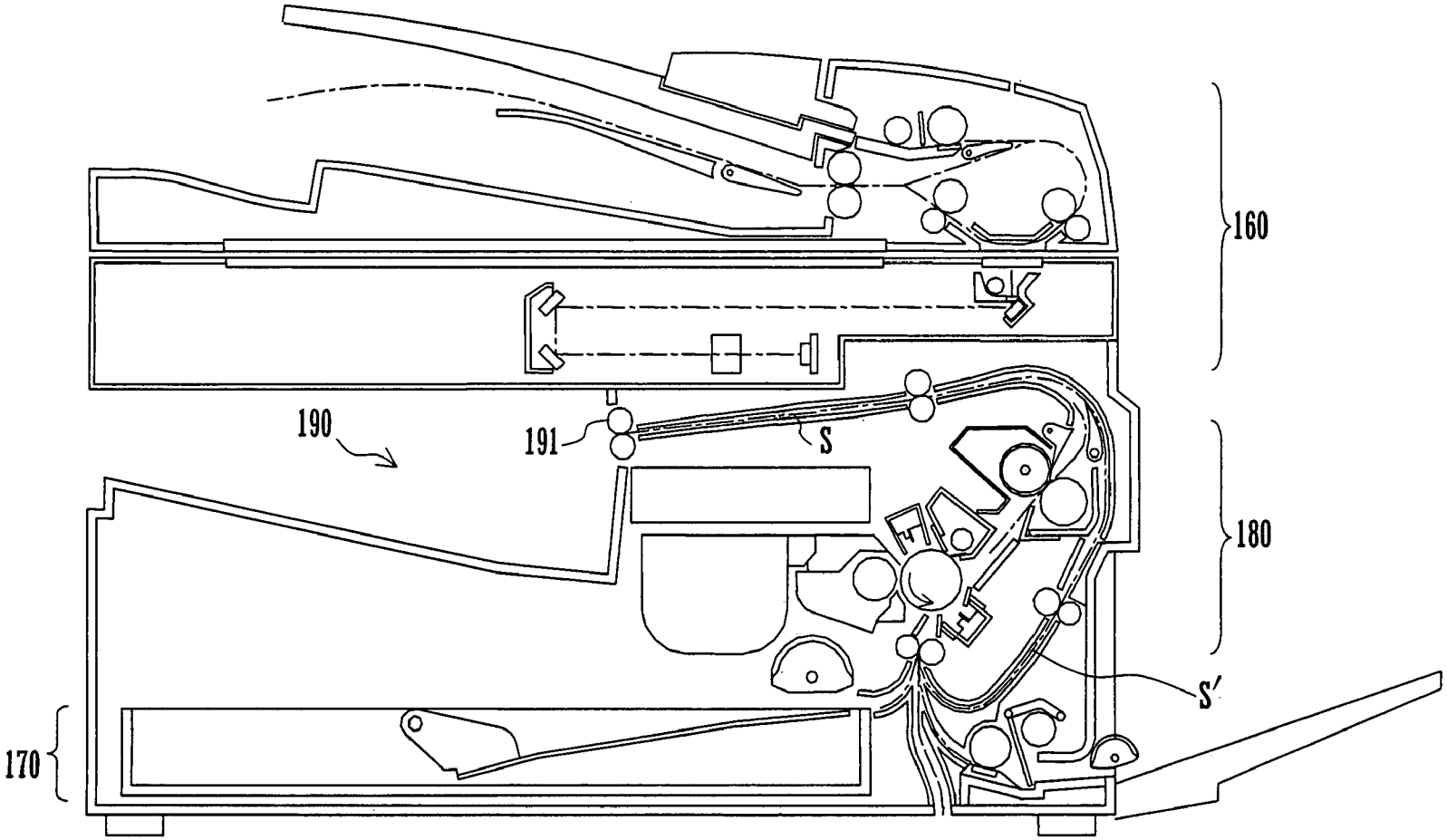
PRIOR ART FIG.7
FIG. 7 is a sectional view showing the construction of a conventional image forming apparatus.

Although the offset mechanism 60 is associated with the three connecting gears 73*a*, 73*b*, 73*c* which are movable along the direction of the arrow Y as part of the driving force transmission mechanism 70 in the present embodiment, the invention is not limited to this construction. According to the invention, the output sheet shifter unit 41 may employ an alternative arrangement for transmitting the driving force of the roller turning force generator 65 to the offset roller assemblies 62 provided that the arrangement can freely move along the direction of the arrow Y together with the offset mechanism 60 and is not susceptible to deterioration. Shown in FIG. 6 is one of such alternative arrangements. As show in FIG. 6, the shaft 72 has flangelike projecting parts 74*b* mounted on the sliding sleeve 74 for limiting sliding motion of the sliding sleeve 74 along the direction of the arrow Y. An endless belt 85 is mounted between the shaft 63*a* and the projecting parts 74*b* on the shaft 72. In this arrangement, the belt 85 transmits the driving force of the roller turning force generator 65 to the offset roller assemblies 62. When the internal enclosure 61 moves along the direction of the arrow Y, the belt 85 shifts in the same direction together with the offset mechanism 60. This is because one of the edges of the hole formed in the internal enclosure 61 comes into contact with one of the projecting parts 74*b* when the internal enclosure 61 moves.

Figure 5:
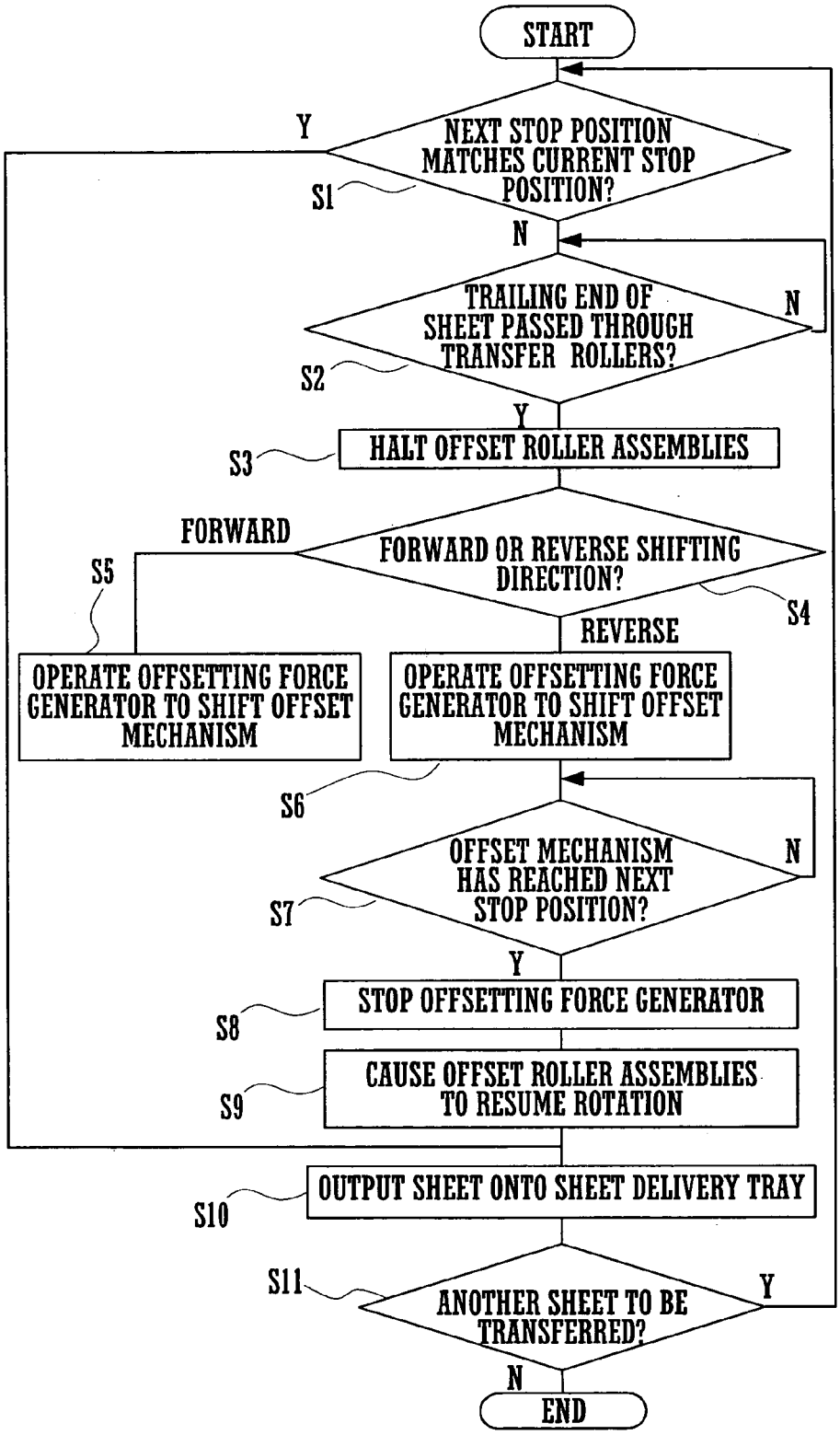
FIG. 5 is a flowchart showing a procedure performed by the output sheet shifter unit for outputting the printed sheets to the offset delivery positions.

FIG. 5 is a flowchart showing a procedure of offset sheet delivery operation performed by the output sheet shifter unit 41 for outputting individual sheets to the offset delivery positions. Here, it is intended to produce multiple copies of a multiple-page document and output the individual copies to the offset delivery positions using the sorting function. First, a judgment is made to determine whether a current stop position of the offset mechanism 60 coincides with a next stop position of the offset mechanism 60 corresponding to a sheet delivery position where a sheet transferred next should be discharged (step S1). If the current stop position coincides with the next stop position, the output sheet shifter unit 41 outputs a printed sheet onto the sheet delivery tray 42 by causing the offset roller assemblies 62 to rotate (step S10). While the sheet is being discharged, the offset roller assemblies 62 are kept rotating by causing the roller turning force generator 65 to continuously to run except when it is necessary to halt the offset roller assemblies 62.

Figure 4:
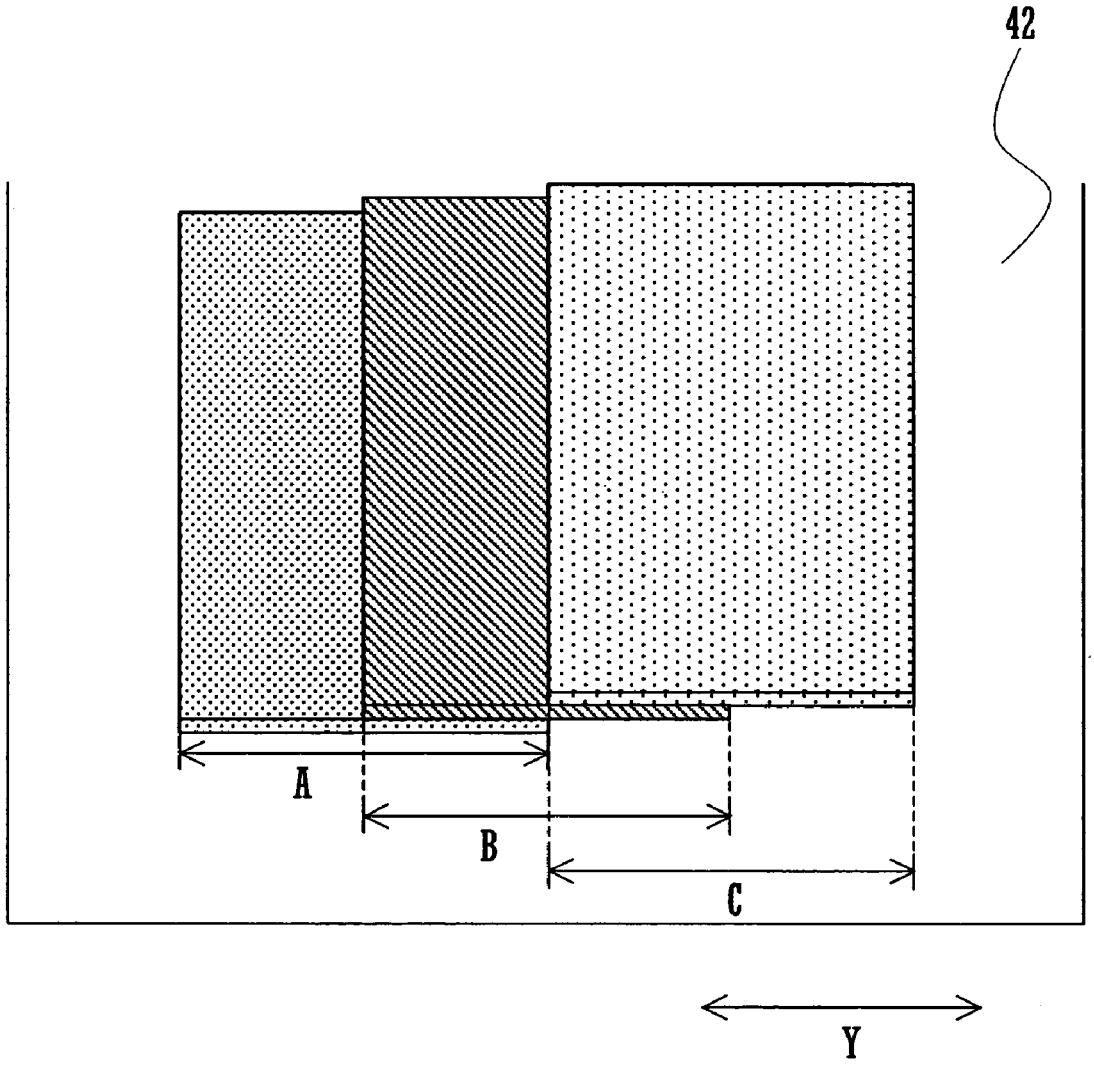
FIG. 4 is a diagram showing offset delivery positions on a sheet delivery tray where the image forming apparatus delivers printed sheets with the output sheet shifter unit.

If the judgment result in step S1 above is in the negative, that is, the current stop position of the offset mechanism 60 is judged to be differing from the next stop position of the offset mechanism 60 corresponding to the sheet delivery position where the sheet transferred next should be discharged, a further judgment is made by using an unillustrated sensor, for example, to determine whether a trailing end of a sheet transferred through the sheet transport path S has passed through transfer rollers 52 located immediately upstream of the offset roller assemblies 62 along the sheet transport path S (step S2). If the trailing end of the sheet transferred through the sheet transport path S is judged to have passed through transfer rollers 52, the output sheet shifter unit 41 stops the roller turning force generator 65 to operate to halt the offset roller assemblies 62 (step S3). Then, a judgment is made to determine whether in which direction the offset mechanism 60 should be moved next based on the current stop position of the offset mechanism 60 and the next stop position of the offset mechanism 60 (step S4). For the sake of explanation, the direction from the delivery position A to the delivery position C along the arrow Y in FIG. 4 is referred to as a forward shifting direction and the direction from the delivery position C to the delivery position A is referred to as a reverse shifting direction. If the offset mechanism 60 is to be shifted in the forward shifting direction according to the judgment result in step S4, the output sheet shifter unit 41 causes offsetting force generator 75 to shift the offset mechanism 60 in the forward shifting direction (step S5). If the offset mechanism 60 is to be shifted in the reverse shifting direction according to the judgment result in step S4, on the contrary, the output sheet shifter unit 41 causes offsetting force generator 75 to shift the offset mechanism 60 in the reverse shifting direction (step S6).

Subsequently, a judgment is made to determine whether the offset mechanism 60 has reached the next stop position (step S7). The judgment of step S7 is repetitively made until the offset mechanism 60 reaches the next stop position. When the offset mechanism 60 reaches the next stop position (Yes in step S7), the output sheet shifter unit 41 causes the offsetting force generator 75 to stop (step S8). Then, the roller turning force generator 65 is caused to resume operation (step S9) so that the offset roller assemblies 62 rotate to discharge the printed sheet onto the sheet delivery tray 42 (step S10). After the sheet has been discharged, a judgment is made to determine whether there remains another sheet to be transferred through the sheet transport path S (step S11). If there remains another sheet to be transferred, the output sheet shifter unit 41 returns to step S1 above to reexecute the offset sheet delivery operation of FIG. 5. If there is no more sheet to be transferred, the output sheet shifter unit 41 stops to perform the offset sheet delivery operation.

While the offset mechanism 60 is being moved along the direction of the arrow Y with the offsetting force generator 75 activated, the roller turning force generator 65 is held in a non-operating state to simplify a control process for performing the offset sheet delivery operation in the foregoing embodiment. The invention is not limited to this arrangement, though. In one variation of the embodiment, the roller turning force generator 65 and the offsetting force generator 75 may be kept simultaneously operating while the offset sheet delivery operation is being carried out. In one form of variation of this kind, the offsetting force generator 75 exerts its driving force to shift the offset mechanism 60 to a specified stop position during a period between a point in time when the trailing end of the sheet passes through the transfer rollers 52 and a point in time when the sheet is ejected from the output sheet shifter unit 41 by the driving force exerted by the roller turning force generator 65 so that the sheet is discharged to the correct sheet delivery position. This alternative arrangement makes it possible to swiftly discharge individual sheets since each sheet can be offset along the direction of the arrow Y (FIG. 2) while being advanced in the sheet transport direction.

As thus far discussed, the output sheet shifter unit 41 of the present embodiment incorporates the offset mechanism 60 movable along the direction of the arrow Y in which the upper and lower offset roller assemblies 62 are rotatably supported in such a way that each sheet can be discharged in the correct sheet transport direction as well as the three connecting gears 73*a*, 73*b*, 73*c* constituting part of the driving force transmission mechanism 70. The connecting gears 73*a*, 73*b*, 73*c* transmit the driving force of the roller turning force generator 65 for turning the offset roller assemblies 62 and shift along the direction of the arrow Y together with the offset roller assemblies 62. The driving force transmission mechanism 70 does not move in its entirety but only part (the connecting gears 73*a*, 73*b*, 73*c*) of the driving force transmission mechanism 70 moves along the direction of the arrow Y when the offset mechanism 60 incorporating the offset roller assemblies 62 and the connecting gears 73*a*, 73*b*, 73*c* is shifted (offset). It is therefore possible to reduce the amount of space needed for allowing the shifting of the offset roller assemblies 62 along the direction of the arrow Y.

While the three connecting gears 73*a*, 73*b*, 73*c* are shifted, one of the edges of the hole formed in the internal enclosure 61 is held in contact with one of the side surfaces of the connecting gear 73*a* and the gears 73*a*, 73*b*, 73*c* are kept in a meshed state. This serves to prevent wear of meshing portions of the gears 73*a*, 73*b*, 73*c* and precisely transmit the driving force of the roller turning force generator 65 to the offset roller assemblies 62. It is therefore possible to precisely advance individual sheets in a sheet discharging direction.

Furthermore, since the offsetting force generator 75 for shifting the offset mechanism 60 along the direction of the arrow Y and the roller turning force generator 65 for turning the offset roller assemblies 62 are disposed separately from each other, it is possible to simplify the construction of and facilitate the placement of mechanisms for transmitting the respective driving forces.

Since there are two stop positions of the offset mechanism 60 corresponding to the offset delivery positions B and C in addition to a reference stop position of the offset mechanism 60 corresponding to the normal delivery position A used as a reference position for delivery of individual sheets, it is possible to easily sort multiple copies of printed sheets with an increased number of delivery positions. Also, it is possible to discharge the printed sheets to multiple delivery positions located along the direction perpendicular to the sheet transport direction with a minimum increase in space requirements, because only the offset mechanism 60 is shifted along the direction of the arrow Y.

Although there is provided a pair of prime movers (the roller turning force generator 65 and the offsetting force generator 75) in the present embodiment, the invention is not limited thereto. The same advantageous effects as offered by the aforementioned embodiment will be obtained even with a single prime mover if the offset roller assemblies 62 can be rotated and the offset mechanism 60 can be shifted along the direction of the arrow Y in the same fashion as so far discussed.

Although there are two offset sheet delivery positions B, C in addition to the normal delivery position A used as the reference position for delivery of individual sheets in the present embodiment, the invention is not limited to this arrangement. As many sheet delivery positions as necessary may be provided depending on the configuration and physical size of an image forming apparatus.

The first embodiment of the invention so far described has the following features and effects:

(1) The driving force transmission mechanism 70 does not move in its entirety but only part (the connecting gears 73*a*, 73*b*, 73*c*) of the driving force transmission mechanism 70 moves along a direction perpendicular to the sheet transport direction when the offset mechanism 60 incorporating the offset roller assemblies 62 and the connecting gears 73*a*, 73*b*, 73*c* is shifted (offset). It is therefore possible to reduce the amount of space needed for allowing the shifting of the offset roller assemblies 62 along the direction perpendicular to the sheet transport direction.

(2) The connecting gear 73*a* constituting part of the driving force transmission mechanism 70 is slidably fitted on the shaft 72 and the connecting gears 73*a*, 73*b*, 73*c* are together shifted under meshed conditions perpendicularly to the sheet transport direction. This makes it possible to prevent wear of the meshing portions of the gears 73*a*, 73*b*, 73*c* and precisely transmit the driving force of the roller turning force generator 65 to the offset roller assemblies 62. It is therefore possible to precisely advance individual sheets in the sheet discharging direction.

(3) Since the offsetting force generator 75 for shifting the offset mechanism 60 along the sheet transport direction and the roller turning force generator 65 for turning the offset roller assemblies 62 are disposed separately from each other, it is possible to simplify the construction of and facilitate the placement of mechanisms for transmitting the respective driving forces.

(4) While the driving force exerted by one of the driving force generator 65, 75 is being transmitted to the offset mechanism 60, the other of the driving force generator 65, 75 does not transmit any driving force to the offset mechanism 60. This arrangement makes it possible to simplify a control process for discharging printed sheets to multiple delivery positions located along the direction perpendicular to the sheet transport direction.

(5) In one varied form of the embodiment, the roller turning force generator 65 and the offsetting force generator 75 are simultaneously operated to offset a printed sheet along a direction perpendicular to the sheet transport direction while the sheet is being advanced in the sheet transport direction. This arrangement makes it possible to swiftly discharge individual sheets.

(6) The number of sheet delivery positions can be increased by setting multiple stop positions of the offset mechanism 60 in addition to the reference stop position thereof to facilitate the sorting of individual printed sheets. Also, it is possible to selectively discharge the printed sheets to multiple delivery positions located along the direction perpendicular to the sheet transport direction with a minimum increase in space requirements, because only the offset mechanism 60 is shifted along the direction perpendicular to the sheet transport direction.

A sheet delivery mechanism according to a second embodiment of the invention is now described with reference to FIGS. 8 to 11.

Figure 8:
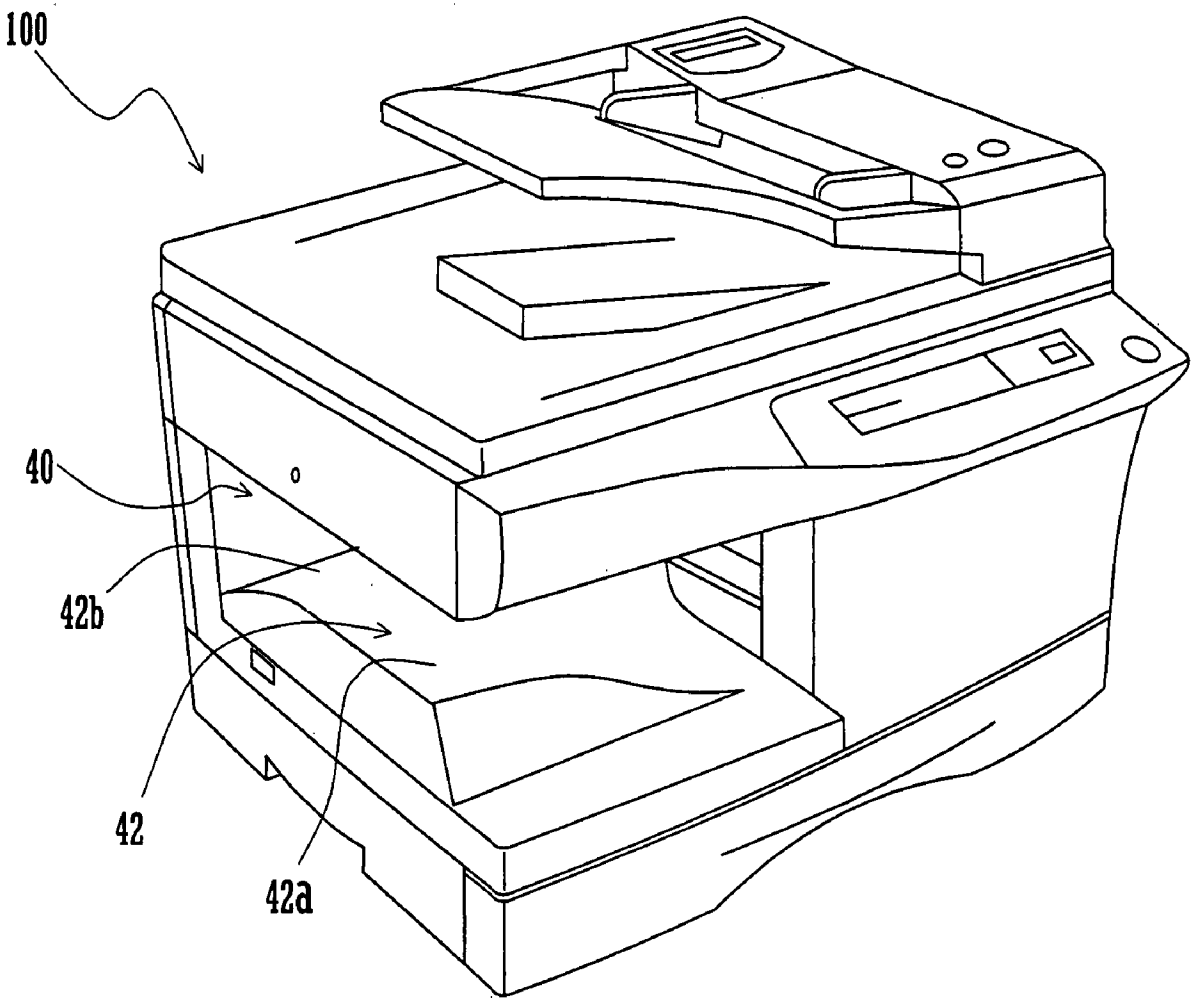
FIG. 8 is a perspective view of an image forming apparatus employing a sheet delivery mechanism according to a second embodiment of the invention.

FIG. 8 is a perspective view of an image forming apparatus 100 employing the sheet delivery mechanism of the second embodiment.

As shown in FIG. 8, a sheet delivery section 40 has a side opening as well as a front opening to offer increased visibility of an inner empty space of the sheet delivery section 40. When a large-sized sheet is discharged, the side opening allows a leading edge of the sheet to stick out to the exterior so that the sheet can be easily removed through either the front or side opening with improved convenience of handling.

The sheet delivery section 40 opens to the exterior on both front and side of the inner empty space without the provision of an upright front wall or an upright pillar at a corner between the front and side of the sheet delivery section 40. This structure ensures high visibility of the inner space of the sheet delivery section 40 and enables a user to remove printed sheets from either the front or side of the image forming apparatus 100 while clearly observing the printed sheets being discharged, thereby offering enhanced ease of handling.

Figure 9:
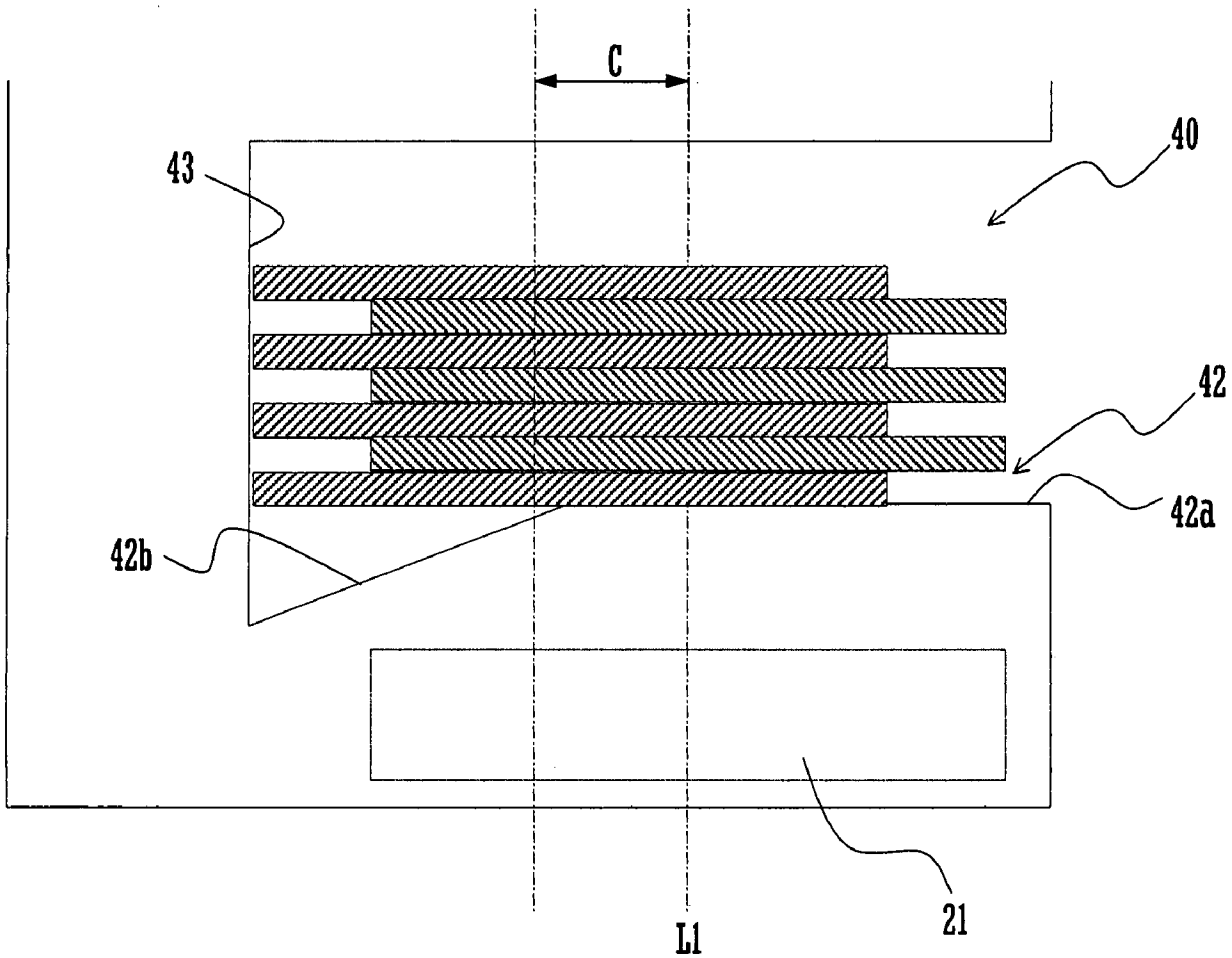
FIG. 9 is an explanatory sectional view showing the structure of a sheet delivery tray of the sheet delivery mechanism of FIG. 8.

Referring to FIG. 9, a sheet delivery tray 42 of the sheet delivery section 40 has a flat surface 42*a* and an inclined surface 42*b* sloping downward from an inner end (rear end) of the flat surface 42*a* toward a rear wall 43. Although the inclined surface 42*b* is shown in a flat form in a sectional view of FIG. 9, the inclined surface 42*b* gently curves in actuality as illustrated in FIG. 8 so that no mark of bending is left in printed sheets at a boundary between the flat surface 42*a* and the inclined surface 42*b*.

Figure 10:
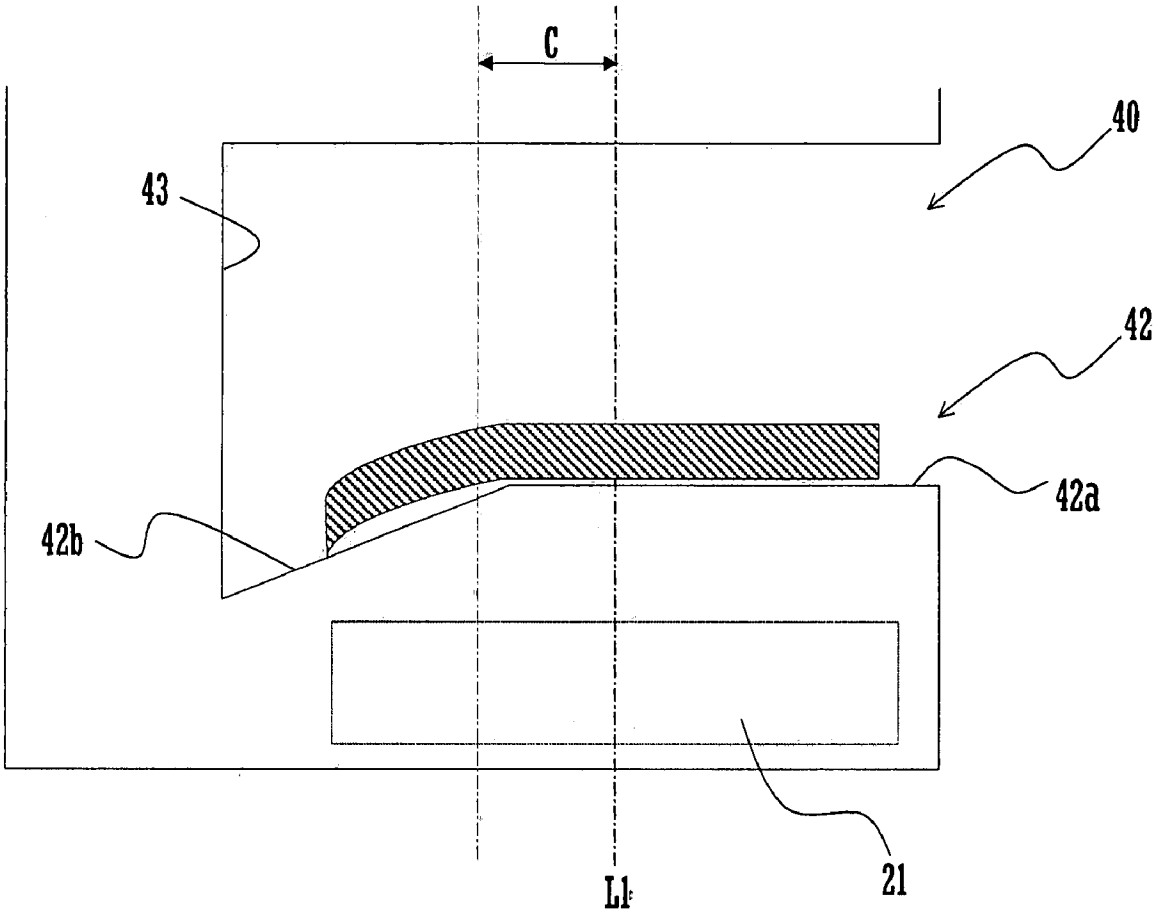
FIG. 10 is a sectional view particularly showing sheets discharged to a non-offset delivery position by the sheet delivery mechanism.

When the sheet delivery mechanism thus constructed discharges printed sheets toward the flat surface 42*a* of the sheet delivery tray 42 under non-offset conditions as shown in FIG. 10, the printed sheets lie at a normal (non-offset) delivery position where a side edge portion of each sheet slightly warps along the inclined surface 42*b* formed between the flat surface 42*a* and the rear wall 43, so that it becomes easier to remove the discharged printed sheets. A pair of chain dotted lines in FIG. 10 indicates an offsetting range C (1 inch in this embodiment) showing a shift width of the sheets discharged to the offset delivery position from a reference center line L1.

Figure 11:
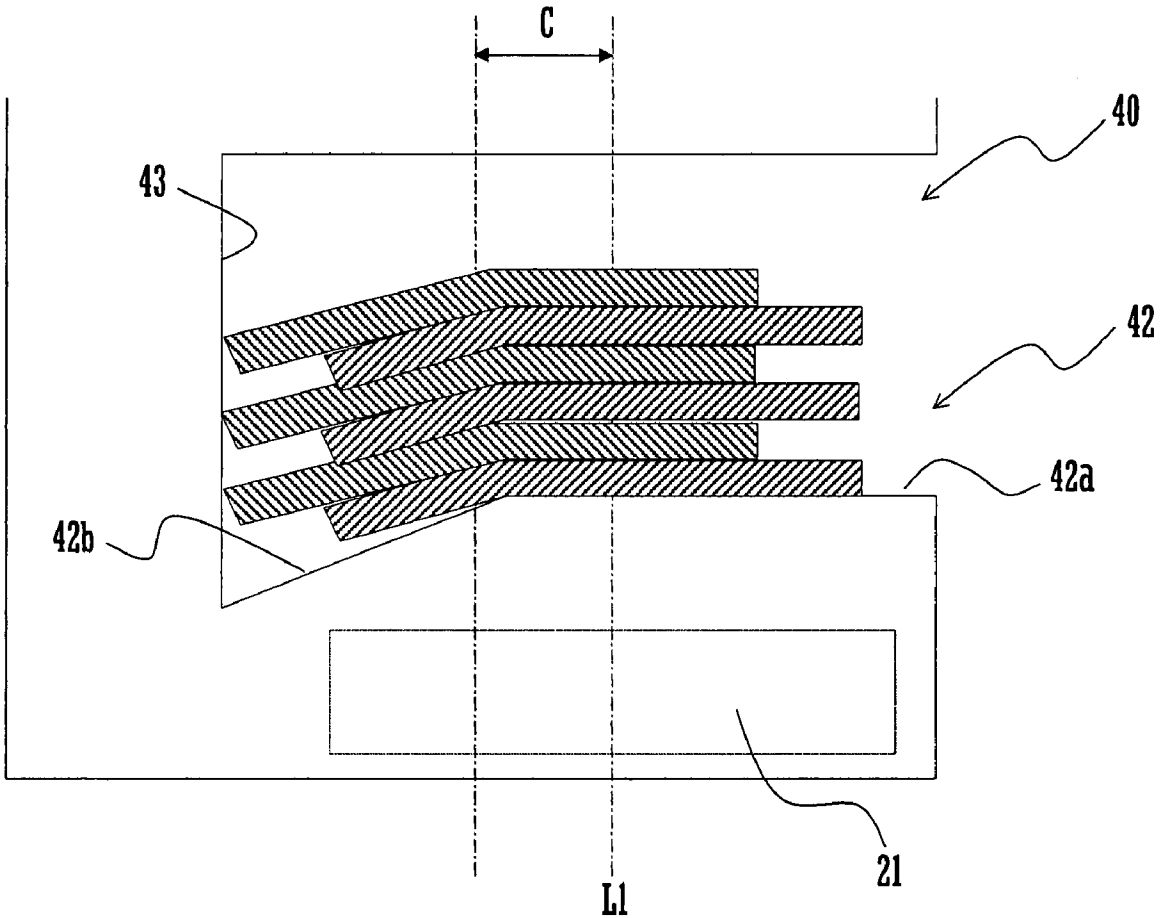
FIG. 11 is a sectional view particularly showing sheets discharged to offset delivery positions by the sheet delivery mechanism.

When an output sheet shifter unit 41 of the sheet delivery mechanism is operated, printed sheets are selectively discharged to the non-offset and offset delivery positions. If multiple sets of printed sheets are discharged alternately to the non-offset and offset delivery positions as shown in FIG. 11, for example, the sheets discharged to the non-offset delivery position are stacked chiefly on the flat surface 42*a* in a stable fashion and the sheets next discharged to the offset delivery position located closer to the rear wall 43 are stacked chiefly on the inclined surface 42*b* with side edges of the sheets aligned with the rear wall 43. Thus, the offset and non-offset sheets are distinctly separated in an easily sortable manner with improved sheet stacking performance.

In the aforementioned construction of the second embodiment, the sheet delivery mechanism ejects the printed sheets to be delivered to the offset delivery position toward the inclined surface 42*b* when the output sheet shifter unit 41 is activated to use its shifter function. In this case, the offset printed sheets are stacked chiefly on the inclined surface 42*b* with the side edges of the sheets aligned with the rear wall 43, so that the offset sheets are distinctly distinguished from the non-offset sheets.

It should be recognized that the aforementioned sheet delivery mechanism of the invention is applicable not only to the image forming apparatus 100 illustrated in FIG. 8 but also to other types of image forming apparatuses. Specifically, the sheet delivery mechanism of the invention is applicable to any front-access-type image forming apparatus regardless of its structure or design, only if the apparatus is of a type including an image scanning section located at an upper part of a housing of the apparatus for scanning an original to obtain image information therefrom, a sheet feeding section located at a lower part of the housing for feeding sheets used for image forming, and an image forming section disposed between the image scanning section and the sheet feeding section at one side of the housing, in which the image scanning section, the image forming section and the sheet feeding section are arranged generally in a U shape in cross section in the housing.

The second embodiment of the invention so far described has the following features and effects:

(1) A sheet delivery portion (the sheet delivery tray 42) located in the inner empty space of the housing just between the image scanning section 10 and the sheet feeding section 20 has the flat surface 42*a* and the inclined surface 42*b* sloping downward from the flat surface 42*a* toward the rear wall 43 of the sheet delivery portion along a direction perpendicular to the sheet transport direction. In this construction, each sheet discharged toward the flat surface 42*a* slightly warps at its side edge portion along the inclined surface 42*b* formed between the flat surface 42*a* and the rear wall 43. This makes it easier to remove the discharged sheets from the sheet delivery portion.

(2) The inner empty space of the housing contiguously opens to the exterior of the housing on both front and side thereof. It is therefore possible to easily remove printed sheets stacked in the sheet delivery portion either through front or side opening. This structure serves to enhance operational ease of the image forming apparatus 100.

(3) Since each sheet is discharged toward the flat surface 42*a* of the sheet delivery portion, individual sheets can be discharged and stacked in a stable fashion even when a large number of printed sheets are produced.

(4) As sheet output rollers (the rollers 62*a*, 62*b*) of the output sheet shifter unit 41 offset printed sheets to selectively discharge them to different delivery positions on the sheet delivery portion, the discharged sheets are distinctly separated (sorted) with improved sheet stacking performance by use of the inclined surface 42*b* adjoining the rear wall 43 of the sheet delivery portion when an offset sheet delivery function is used.

(5) When the output sheet shifter unit 41 is operated, non-offset sheets are discharged onto the flat surface 42*a* of the sheet delivery portion in a stable fashion, so that the non-offset sheets are distinctly separated from offset sheets.

(6) When the output sheet shifter unit 41 is operated, offset sheets are discharged toward the inclined surface 42*b* of the sheet delivery portion. While the offset sheets discharged onto the inclined surface 42*b* are apt to slide downslope toward the rear wall 43 of the sheet delivery portion, the rear wall 43 securely receives the offset sheets along side edges thereof. Therefore, the offset and non-offset sheets are distinctly separated in an easily sortable manner with improved sheet stacking performance.

The invention being thus described, it will be obvious that the same may be varied in many ways. Such variations are not to be regarded as a departure from the spirit and scope of the invention, and all such modifications as would be obvious to one skilled in the art are intended to be included within the scope of the invention.

What is claimed is:

1. A sheet delivery mechanism comprising:

offset rollers rotatably supported for discharging a sheet in a sheet transport direction;

a roller turning force generator for turning the offset rollers via a driving force transmission mechanism;

an offset mechanism comprising a unitary structure rotatably supporting the offset rollers, the offset mechanism including a support structure, mounting means for rotatably mounting the offset rollers on the support structure in the form of opposing offset roller pairs that together define a sheet transport pathway, part of the driving force transmission mechanism, and drive means engaging said part of said transmission mechanism for positively driving opposing offset rollers of each offset roller pair in opposite directions so as to direct a sheet along said sheet transport pathway; and an offsetting force generator for shifting the offset mechanism along a direction perpendicular to the sheet transport direction, the offsetting force generator being connected to the offset mechanism;

wherein the offset mechanism is caused to move along the direction perpendicular to the sheet transport direction without alteration of the engagement of said part of said transmission mechanism with said drive means when the offsetting force generator is operated.

2. The sheet delivery mechanism according to claim 1, wherein the driving force transmission mechanism includes a shaft for turning the offset rollers, the shaft being connected to the roller turning force generator and rotatably supported parallel to the direction perpendicular to the sheet transport direction such that the shaft turns the offset rollers to push out the sheet in the sheet transport direction, and wherein the offset mechanism includes a first gear and a second gear disposed in an internal space of the offset mechanism, the first gear being slidably fitted on the shaft in such a manner that the first gear rotates together with the shaft, and the second gear being meshed with the first gear and connected to a rotary shaft supporting at least part of the offset rollers.

3. The sheet delivery mechanism according to claim 1, wherein the offsetting force generator is disposed separately from the roller turning force generator.

4. The sheet delivery mechanism according to claim 3, wherein the offsetting force generator exerts a driving force to the offset mechanism during a period between a point in time when a trailing end of the sheet passes by a sheet transfer roller disposed immediately upstream of the offset rollers along a sheet transport path and a point in time when the sheet is nipped by the offset rollers, and the roller turning force generator does not exert any driving force to the offset rollers while the offsetting force generator is exerting the driving force to the offset mechanism.

5. The sheet delivery mechanism according to claim 3, wherein the offsetting force generator exerts a driving force to the offset mechanism during a period between a point in time when a trailing end of the sheet passes by a sheet transfer roller disposed immediately upstream of the offset rollers along a sheet transport path and a point in time when the sheet is ejected from the sheet delivery mechanism by a driving force exerted by the roller turning force generator so that the offset mechanism is shifted to a specified position.

6. The sheet delivery mechanism according to claim 1, wherein the offset rollers can be moved to multiple stop positions from a reference stop position by shifting the offset mechanism along a direction perpendicular to the sheet transport direction.

7. An image forming apparatus comprising:

a housing having an upper part, a lower part, a front, a rear and opposing sides:

an image scanning section located at an upper part of the housing of the apparatus for scanning an original to obtain image information therefrom;

a sheet feeding section located at a lower part of the housing for feeding sheets used for image forming; and an image forming section disposed between the image scanning section and the sheet feeding section at one side of the housing;

wherein the image scanning section, the image forming section and the sheet feeding section are arranged generally in a U shape in cross section in the housing, and a sheet delivery portion is formed in an inner empty space of the housing between the image scanning section and the sheet feeding section;

wherein the sheet delivery portion includes a flat surface and an inclined surface that slopes downwardly from the flat surface toward the rear of the housing ;and wherein the inner empty space of the housing contiguously opens to the exterior of the housing on both the front and the side thereof opposite to said image forming section.

8. The image forming apparatus according to claim 7, wherein the flat surface of the sheet delivery portion serves as a sheet delivery area where printed sheets are delivered.

9. The image forming apparatus according to claim 7 further comprising a shifter including rollers for offsetting printed sheets along the direction perpendicular to the sheet transport direction to selectively discharge the printed sheets to different sheet delivery positions on the sheet delivery portion.

10. The image forming apparatus according to claim 9, wherein one of the sheet delivery positions lies on the flat surface of the sheet delivery portion.

11. The image forming apparatus according to claim 9, wherein the sheet delivery positions excluding one lying on the flat surface of the sheet delivery portion lie on the inclined surface of the sheet delivery portion.

* * * * *